US011229996B2

(12) United States Patent
Nagao

(10) Patent No.: US 11,229,996 B2
(45) Date of Patent: Jan. 25, 2022

(54) FASTENING TOOL

(71) Applicant: Koki Holdings Co., Ltd., Tokyo (JP)

(72) Inventor: Masaya Nagao, Ibaraki (JP)

(73) Assignee: Koki Holdings Co., Ltd., Tokyo (JP)

( * ) Notice: Subject to any disclaimer, the term of this patent is extended or adjusted under 35 U.S.C. 154(b) by 584 days.

(21) Appl. No.: 16/097,268

(22) PCT Filed: Mar. 31, 2017

(86) PCT No.: PCT/JP2017/013670
§ 371 (c)(1),
(2) Date: Oct. 28, 2018

(87) PCT Pub. No.: WO2017/187892
PCT Pub. Date: Nov. 2, 2017

(65) Prior Publication Data

US 2019/0111552 A1 Apr. 18, 2019

(30) Foreign Application Priority Data

Apr. 28, 2016 (JP) ..... JP2016-090365

(51) Int. Cl.
*B25C 1/00* (2006.01)
*B25C 1/04* (2006.01)
*B25C 7/00* (2006.01)

(52) U.S. Cl.
CPC ..... *B25C 1/008* (2013.01); *B25C 1/04* (2013.01); *B25C 1/047* (2013.01); *B25C 7/00* (2013.01)

(58) Field of Classification Search
CPC .. B25C 1/008; B25C 1/04; B25C 7/00; B25C 1/047
See application file for complete search history.

(56) References Cited

U.S. PATENT DOCUMENTS 3,964,659 A * 6/1976 Eiben ..... B25C 1/043 227/8
4,834,131 A * 5/1989 Austin ..... B25C 1/008 137/115.26

(Continued)

FOREIGN PATENT DOCUMENTS

CN 101712148 5/2010
CN 103372846 10/2013

(Continued)

OTHER PUBLICATIONS

"Search Report of Europe Counterpart Application", dated Mar. 27, 2020, p. 1-p. 8.

(Continued)

*Primary Examiner* — Hemant Desai
*Assistant Examiner* — Mobeen Ahmed
(74) *Attorney, Agent, or Firm* — JCIPRNET

(57) ABSTRACT

A fastening tool is provided, wherein a relief valve piston (65) is arranged that blocks an air passage from an air plug (58) to an accumulator chamber (50) and that opens/closes a flow path of a discharge port of compressed air from the accumulator chamber (50) to the atmosphere. When a state in which a trigger lever (21) is pulled while a push lever is released continues for a prescribed time or longer, a portion of the compressed air in the accumulator chamber (50) is released to the outside from the discharge port to notify the operator that the trigger lever (21) has not returned. If the trigger lever (21) is not returned even after the notification, the compressed air in the accumulator chamber (50) is discharged to the atmosphere at once and an air passage from an air plug (58) to the accumulator chamber (50) is blocked.

10 Claims, 8 Drawing Sheets

(56) References Cited

U.S. PATENT DOCUMENTS

| | | | | |
|---|---|---|---|---|
| 5,673,759 | A * | 10/1997 | Biek | B25B 21/02 173/178 |
| 6,161,628 | A * | 12/2000 | Liu | B25D 9/20 173/114 |
| 6,523,621 | B1 * | 2/2003 | Gosis | B25C 1/008 173/206 |
| 7,191,927 | B2 * | 3/2007 | Segura | B25C 1/008 227/142 |
| 10,569,402 | B2 * | 2/2020 | Iijima | B25C 1/008 |
| 10,596,690 | B2 * | 3/2020 | Weigmann | B25C 1/047 |
| 10,688,641 | B2 * | 6/2020 | Weigmann | B25C 1/06 |
| 2001/0009260 | A1 * | 7/2001 | Ishizawa | B25C 1/043 227/8 |
| 2002/0125290 | A1 * | 9/2002 | Robinson | B25C 1/043 227/8 |
| 2002/0158102 | A1 * | 10/2002 | Patton | F04B 35/04 227/8 |
| 2007/0059186 | A1 * | 3/2007 | Weaver | B25C 1/04 417/234 |
| 2008/0135598 | A1 * | 6/2008 | Burke | B25C 1/047 227/130 |
| 2013/0082083 | A1 * | 4/2013 | Largo | B25C 1/041 227/8 |
| 2014/0090732 | A1 * | 4/2014 | Schieler | B25C 1/041 137/565.18 |
| 2019/0022842 | A1 * | 1/2019 | Oouchi | B25C 7/00 |
| 2019/0344415 | A1 * | 11/2019 | Furumi | B25C 1/047 |
| 2020/0189078 | A1 * | 6/2020 | Theberath | B25C 1/047 |

FOREIGN PATENT DOCUMENTS

| | | |
|---|---|---|
| CN | 103522259 | 1/2014 |
| DE | 4431771 | 3/1995 |
| DE | 202014102397 | 6/2014 |
| EP | 1223009 | 7/2002 |
| JP | S50128780 | 10/1975 |
| JP | S51148873 | 12/1976 |
| JP | S5786776 | 5/1982 |
| JP | H0261580 | 5/1990 |
| JP | H0270980 | 5/1990 |
| JP | 2002254348 | 9/2002 |
| JP | 2012115922 | 6/2012 |
| JP | 4964624 | 7/2012 |
| WO | 2012154797 | 11/2012 |

OTHER PUBLICATIONS

Office Action of China Counterpart Application, with English translation thereof, dated Mar. 2, 2021, pp. 1-13.

"International Search Report (Form PCT/ISA/210) of PCT/JP2017/013670," dated May 16, 2017, with English translation thereof, pp. 1-4.

* cited by examiner

FASTENING TOOL

CROSS-REFERENCE TO RELATED APPLICATION

This application is a 371 application of the international PCT application serial no. PCT/JP2017/013670, filed on Mar. 31, 2017, which claims the priority benefit of Japan application no. 2016-090365, filed on Apr. 28, 2016. The entirety of each of the above-mentioned patent applications is hereby incorporated by reference herein and made a part of this specification.

BACKGROUND OF THE INVENTION

Technical Field

The present invention provides a structure that prevents an unintended driving in a fastening tool when the fastening tool is kept in a state that an operator forgets to return the trigger, wherein the fastening tool drives fasteners such as nails or the like by a cooperative action of two switch mechanisms which are a first switch and a second switch; the first switch is operated by a trigger and the second switch is operated by a push lever that moves corresponding to an operation of pressing a leading end of an injection port of the fastener toward a driven material.

Related Art

A transportable fastening tool is known which uses compressed air supplied from an air compressor to sequentially drive out fasteners filled in a magazine from a leading end of a driver blade. Such a fastening tool is disclosed in patent literature 1; in an initial state, a push lever is energized toward a bottom dead center side (a driven material side) at the front of the leading end of a nose, and a driving of the fasteners is performed in a state that the push lever is pressed to the driven material. FIG. 8 is a drawing showing a configuration of a conventional fastening tool 101. The fastening tool 101 is provided with a safety mechanism, and when a push lever 15 at the leading end of an injection part is not in contact with the driven material, the safety mechanism cannot start a strike driving part even if the pulling operation of a trigger lever 21 is performed. Besides, when a plurality of nails is driven sequentially, a so-called "continuous driving operation" can be performed, that is, a state is kept in which the pulling operation of the trigger lever 21 is maintained even when the driving of the nails is completed, the nail is driven by moving the main body of the fastening tool 101 and pressing the push lever 15 to the next driving position, and the same operation is repeated to perform the driving continuously. An accumulator chamber 150 is formed inside a body part 102*a* and a handle part 102*b* of a housing 102 and inside a top cover 3, and the compressed air is supplied from an unillustrated external compressor or the like to the accumulator chamber 150 via a connection hose (not illustrated) that is connected to an air plug 58.

LITERATURE OF RELATED ART

Patent Literature

Patent literature 1: Japanese Laid-Open No. 2012-115922

SUMMARY

Problems to be Solved

In a continuous driving mode of patent literature 1, a driving operation is performed when both a trigger and a push lever are in an ON state. In the driving operation, there is a continuous driving operation for quickly fixing a wide region, and there are also other operations in which a continuous driving operation is temporarily interrupted to carefully perform a driving aiming at a prescribed position in, for example, a terminal region where the continuous driving operation is completed or a region where the base is switched. In such a timing of operation switch, when the operator senses an extension of the continuous driving and maintains the trigger in the ON state to perform an operation aiming at the prescribed position, the continuous driving is restarted if the push lever is in the ON state, so that the driving may be performed in a position slightly deviated from the prescribed position (a miss shot). Although such a driving deviation can be eliminated by frequently returning the trigger after the continuous driving operation is ended, from the perspective of improving the convenience for the operator, it is more desirable to have some structures for supporting the operator.

Therefore, one purpose of the present invention is to provide a fastening tool which performs a driving operation via two switch mechanisms, namely a push lever and a trigger, and can continuously drive the fasteners by repeating an operation that causes the push lever to move from a bottom dead center to a top dead center in a state that a pulling operation of the trigger is maintained; even when the trigger is maintained in the ON state, the compressed air in the main body is automatically discharged after a fixed time, thereby suppressing the subsequent continuous driving operation, and the miss shot is prevented by operating the trigger when the operator intends to drive again. Another purpose of the present invention is to provide a fastening tool which gives a notification that a trigger pulling operation is continued by a sound after a fixed time when an operator maintains the trigger in an ON state. Furthermore, another purpose of the present invention is to provide a fastening tool which discharges compressed air of an accumulator chamber and suppresses the subsequent continuous driving operation when an operator maintains the trigger in an ON state after the notification that a trigger pulling operation is continued is given by a sound after a fixed time.

Means to Solve Problems

Characteristics of a representative invention in the inventions disclosed in the present application are described as follows. According to the characteristic of the present invention, a fastening tool includes: a housing; an accumulator chamber that is configured to be a part of the housing and accumulates compressed air; a piston that reciprocates in a cylinder due to the compressed air; a driver blade that is connected to the piston and drives a fastener; a nose member having an injection port for injecting the fastener; a push lever that moves to a first position along the nose member when causing a leading end of the injection port to move in a pressing direction toward a driven material, and moves to a second position along the nose member when the leading end of the injection port is not pressed to the driven material; a trigger that actuates a switch mechanism for controlling air discharge of the accumulator chamber, wherein in a state that the push lever is moved to the first position and the trigger is pulled, by communicating the accumulator chamber with an upper chamber of the piston, the compressed air in the accumulator chamber flows into the cylinder and a strike is performed accordingly. The fastening tool includes a discharge mechanism that has a control valve and discharges at least a portion of the compressed air to an outside by an operation of the control valve, wherein the control valve is controlled by the compressed air and limits an inflow of the compressed air towards the accumulator chamber by pulling the trigger when the push lever is in the second position. The discharge mechanism makes a notification sound by discharging a portion of the air in the accumulator chamber to the outside. The discharge mechanism is configured to include a relief valve mechanism that reduces a pressure of the accumulator chamber by discharging the air of the accumulator chamber to the outside at once when a state of the trigger being pulled is further continued in a state that the notification sound is made.

According to another characteristic of the present invention, the housing includes a substantially cylindrical body part and a handle part extending from the body part in a substantially perpendicular direction, an air plug for supplying the compressed air from the outside is arranged on an end part of the handle part which is separated from the body part, and a relief valve mechanism is disposed in a space between the air plug and the trigger. Besides, the relief valve mechanism is provided with an opening and closing valve of an inflow pathway from the air plug to the accumulator chamber, and the discharge valve of a discharge pathway for discharging the air in the accumulator chamber to the outside; the inflow pathway is kept open when the notification sound is made, and the inflow pathway is closed when the air in the accumulator chamber is discharged to the outside at once. Furthermore, after the air in the accumulator chamber is discharged to the outside at once, a state that the inflow pathway is closed is maintained until the state that the trigger is pulled is released.

According to still another characteristic of the present invention, the relief valve mechanism includes: a relief valve piston that can be used as both the opening and closing valve of the inflow pathway and the discharge valve of the discharge pathway; and a relief valve case that defines a space allowing the relief valve piston to slide and that forms an inflow passage and a discharge passage; and a connection pathway is arranged in which a portion of the compressed air is supplied from the trigger to the air chamber between the relief valve piston and the relief valve case in order to perform the movement of the relief valve piston.

According to still another characteristic of the present invention, a fastening tool is configured in a manner that an air plug that supplies the compressed air to the accumulator chamber is arranged in the housing; a discharge port for discharging the compressed air in the accumulator chamber is arranged; a relief valve that operates by an air pressure and that opens and closes the discharge port is arranged near the air plug; an air passage is arranged that supplies a portion of the compressed air to the relief valve side when the trigger is pulled; a prescribed amount of air flows to the relief valve through the air passage and the pressure of the valve chamber increases gradually, and the compressed air in the accumulator chamber is discharged to the outside of the housing if an air pressure applied to the relief valve increases. Besides, the relief valve has a housing and includes: an air chamber for receiving the pressure of the air supplied from the air passage; an energizing means for energizing the relief valve piston in a direction opposite to the pressure; and an inflow passage of the compressed air from the air plug to the accumulator chamber; and the relief valve opens the discharge port and closes the inflow passage when discharging the compressed air in the accumulator chamber to the outside of the housing. Furthermore, an adjustment mechanism is arranged that adjusts a required time from a start of the operation of the trigger to the discharge of the compressed air. If the trigger is returned after the compressed air is discharged, the discharge port is closed and the inflow passage is opened by releasing the air in the valve chamber to the atmosphere.

According to still another characteristic of the present invention, a fastening tool is provided with an air driven timer valve that blocks an air passage from the air plug to the accumulator chamber and that opens and closes a discharge port for discharging the compressed air from the accumulator chamber to an atmosphere. If a state of the trigger being pulled continues for a prescribed time or longer when the push lever is in the second position, the compressed air in the accumulator chamber is released to the outside by the air driven timer valve, and the air passage from the air plug to the accumulator chamber is blocked. Besides, before reaching the prescribed time, a portion of the air which flows into the air driven timer valve leaks to the outside of the housing, thereby notifying an operator of a discharge operation of the accumulator chamber by an air leakage sound. Furthermore, after the air leakage sound continues for a prescribed time or longer, the compressed air in the accumulator chamber is released to the outside and the air passage from the air plug to the accumulator chamber is blocked.

Effect

According to the present invention, in a continuous driving operation, when the operator maintains a trigger in an ON state longer than usual, a notification that the pulling operation of the trigger is continued can be given by a sound, thereby drawing the attention of the operator. Besides, when the pulling operation of the trigger continues even after the notification is made, the compressed air in the accumulator chamber is compulsorily discharged, and thus the driving to an unintended position (a miss shot) can be greatly suppressed. Furthermore, when it is configured in a manner that the attention is drawn by a notification sound for a prescribed period instead of performing the discharge of the compressed air of the accumulator chamber compulsorily without notification, the operator can predict a discharge timing and an easy-to-use fastening tool can be realized. The above-mentioned and other purposes and novel characteristics of the present invention can be understood according to the description in the specification below and the drawings.

Figure 7:
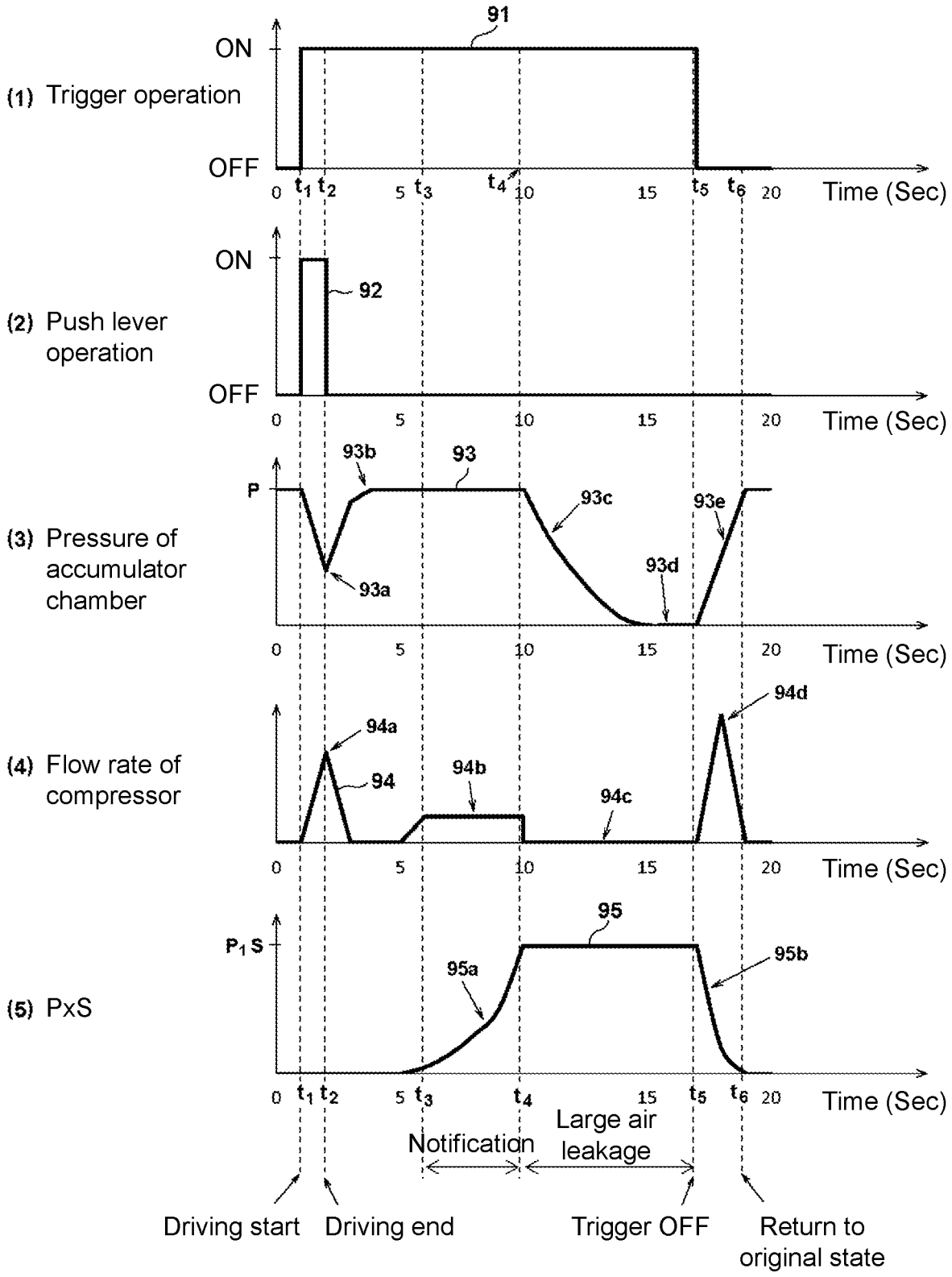

(1)~(5) of FIG. 7 are drawings illustrating a relationship between the states of each part until discharging the air of an accumulator chamber according to the embodiment.

Figure 8:
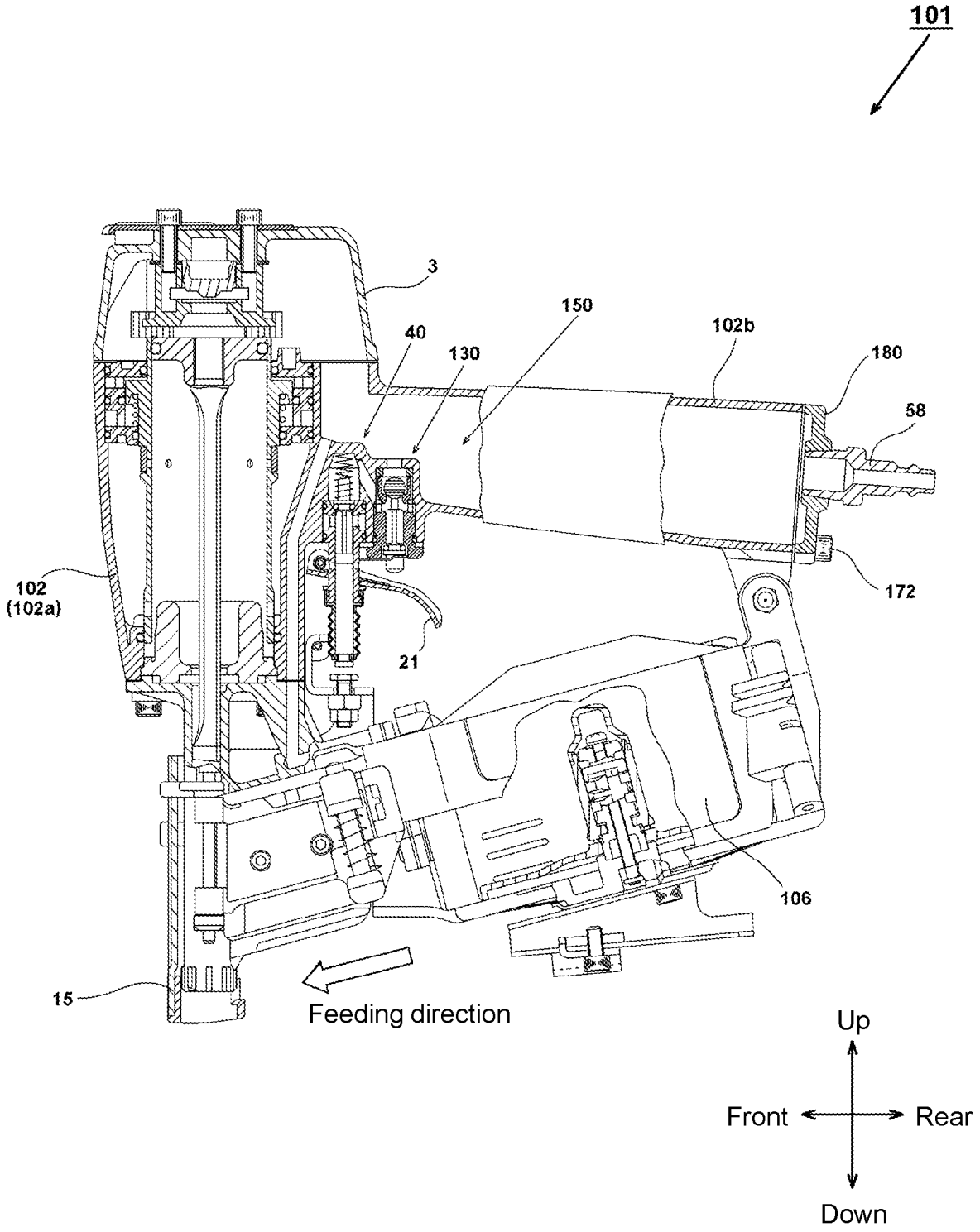
FIG. 8 (RELATED ART)

FIG. 8 is a longitudinal cross-sectional view of an overall configuration of a conventional fastening tool 101.

DESCRIPTION OF THE EMBODIMENTS

Embodiment 1

Embodiments of the present invention are illustrated below with reference to drawings. In the following embodiments, for the sake of convenience, a state is used as a reference in which a fastening tool is arranged so that a driving direction of a fastener is vertically downward, and the up and down, left and right, and front and rear directions are defined and illustrated as shown in the drawings.

Figure 1:
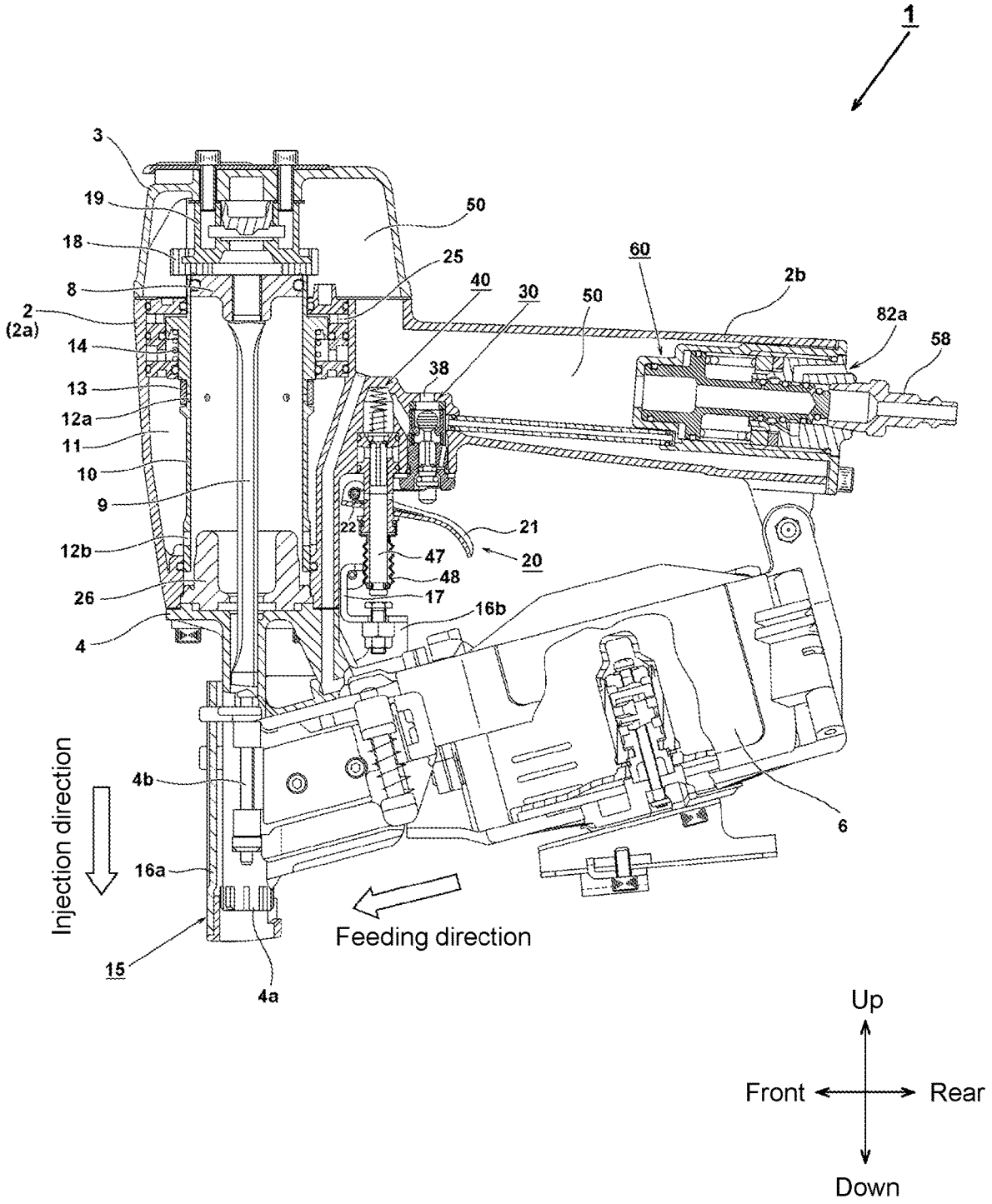
FIG. 1 is a longitudinal cross-sectional view of an overall configuration of a fastening tool 1 according to an embodiment of the present invention.

FIG. 1 is a longitudinal cross-sectional view of an overall configuration of a fastening tool 1 of the embodiment. An outer case of the fastening tool 1 (a housing in a broad sense) is formed by a substantially cylindrical body part 2*a* that covers a space for the reciprocating movement of a piston described below, a handle part 2*b* that extends in a direction substantially perpendicular to an injection direction from the body part 2*a*, a top cover 3 that covers an opening part on one end side (an upper side) in an axial direction of the body part 2*a*, and a nose member 4 that covers an opening part on the other end side (a lower side) in the axial direction of the body part 2*a*. The handle part 2*b* becomes a part that an operator grips. An air plug 58 is arranged on a rear end of the handle part 2*b*, and compressed air is supplied from an external compressor (not illustrated) via an unillustrated air hose. Inside the handle part 2*b* and the top cover 3, accumulator chambers 50 that are configured to accumulate the compressed air from the unillustrated compressor are formed. The nose member 4 is made of a material obtained by applying a heat treatment to alloy steel raw material, and an injection passage 4*b* through which nails driven by a driver blade (described later) pass is arranged inside. An opening part (not illustrated) for sequentially feeding the nails is arranged on a part of a side surface of the nose member 4, and one end side of a magazine 6 that feeds the nails is mounted so as to surround the opening part. The magazine 6 is disposed so that a longitudinal direction (feeding direction) of the magazine 6 is slightly inclined relative to the injection direction, accommodates the unillustrated roller-bonded nails, and sequentially supplies the nails to the injection passage 4*b*. The structure of the magazine 6 is publicly known so that detailed description is omitted here.

A push lever 15 is arranged on a leading end of the nose member 4. The push lever 15 is a movable member capable of moving relative to the nose member 4 within a prescribed range in the same direction and the opposite direction of the injection direction; in a state that the leading end 4*a* that is the injection port of the nose member 4 is not pressed toward the driven material, the push lever 15 is located on the lower side (a second position) as shown in FIG. 1. When an operation is performed that the leading end 4*a* of the nose member 4 is pressed toward the driven material, the push lever 15 moves to the upper side (a first position), and a push lever bush 47 is moved upward by an upward movement of an arm part 16*a* and a coupling part 16*b* of the push lever 15, and a connection part 17. A flange part in which the diameter is expands in a flange shape is formed at the lower end of the push lever plunger 41 (FIG. 2), and between this flange part and the flange part formed at the lower end of the push lever bush 47 and a push lever bush cover 48, a spring arranged on the back side of the paper surface (not illustrated) is inserted to energize the push lever bush 47 downward. A trigger 20 is configured to include a rocking shaft 22 that is disposed near the base of the handle part 2*b* and the body part 2*a*, and a trigger lever 21 that rocks taking the rocking shaft 22 as a center. In the specification, pulling the trigger 20 or the trigger lever 21 means to cause the trigger lever 21 to move toward the opposite side (upward) of the injection direction. The operator presses the leading end (the lower end) of the push lever 15 to an object (the driven material) to which the nail is driven, and pulls the trigger lever 21; by the two operations, the operator can start a strike driving element including a piston 8 to drive the nails.

The strike driving element of the fastening tool 1 is configured to include a cylindrical cylinder 10, a piston 8 capable of sliding (reciprocating) up and down in the cylinder 10, and a driver blade 9 connected to the piston 8. The driver blade 9 is used to strike the fastener such as the nails, and is disposed so as to extend downward from the lower end side of the cylindrical cylinder 10. The driver blade 9 can be manufactured integrally with or separately from the piston 8.

The cylinder 10 slidably supports the piston 8 with an inner surface, and expands in a flange shape toward the radial outside in the opening on the upper end side. The cylinder 10 is maintained so as to be energized upward by a spring 14 disposed on the lower side of the cylinder 10, and can move slightly downward. The inside of the cylinder 10 is divided into an upper piston chamber and a lower piston chamber by the piston 8. The upper chamber of the piston 8 is formed underneath a head cap 18 in contact with the upper end part of the cylinder 10. The head cap 18 is arranged on the lower side of a valve holding member 19.

A return air chamber 11 configured to store the compressed air for returning the driver blade 9 to the top dead center is formed on an outer periphery on the lower side of the cylinder 10. A plurality of air holes 12*a* is formed in the central part in the axial direction of the cylinder 10, and the air holes 12*a* allow an inflow of the compressed air only in one direction from the inside of the cylinder 10 to the outside return air chamber 11. A check valve 13 is provided on the outer periphery side of the cylinder 10. Besides, an air hole 12*b* which is always open in the return air chamber 11 is formed under the cylinder 10. A piston bumper 26 is arranged on the lower end of the cylinder 10. The piston bumper 26 is made of elastomers such as rubber to absorb the remaining energy after a nail is driven by a rapid downward movement of the piston 8, and has a through hole in the center for an insertion of the driver blade 9.

The portion of the handle part 2*b* connected to the fastening tool 1 is provided with the trigger lever 21 operated by the operator, a first switch 30 that communicates with the accumulator chamber 50 and that opens or blocks the passage of the compressed air, and a second switch 40 that communicates with an outlet side of the first switch 30 on one hand and communicates with a passage passing through a main valve chamber 25 on the other hand. The first switch 30 and the second switch 40 are respectively configured to include an opening and closing valve that allows or blocks the flow of air. A relief valve mechanism 60 is disposed at the end of the handle part 2*b* on a side separated from the body part 2*a*. The relief valve mechanism 60 is disposed between the first switch 30 which are opened and closed by the trigger lever 21 and the air plug 58, and includes an opening and closing valve that operates by air pressure and that controls air inflow from the air plug 58 to the accumulator chamber 50, and an discharge valve that controls air discharge from the accumulator chamber 50 to a discharge port 82*a*. Here, the relief valve mechanism 60 is arranged near the air plug 58.

During the driving, when the leading end 4*a* of the nose member 4 is pressed toward the driven material and the first switch 30 and the second switch 40 are on by operating the trigger lever 21, high-pressure air flows from the accumulator chamber 50 to the first switch 30 and the second switch 40 through a through hole 38, reaches the main valve chamber 25 and causes the cylinder 10 to move downward. Due to the movement, the head cap 18 is separated from the upper side opening of the cylinder 10, and the compressed air flows from the accumulator chamber 50 in the top cap 3 to the upper piston chamber at once. The drive blade 9 drops rapidly along with the piston 8 due to the inflow of the compressed air, and the drive blade 9 slides in the injection passage 4*b* to drive the unillustrated nails fed into the injection passage 4*b* to the driven material.

Figure 2:
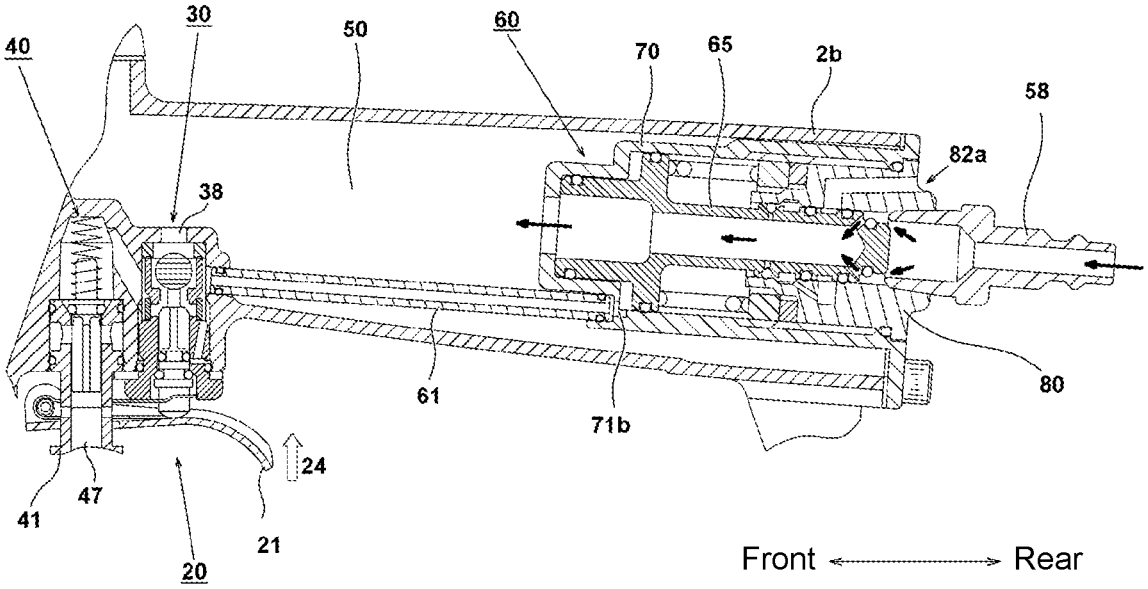
FIG. 2 is an enlarged cross-sectional view showing a structure near a handle part 2*b* of the fastening tool 1 according to the embodiment of the present invention (during normal state).

FIG. 2 is an enlarged cross-sectional view showing a structure near the handle part 2*b* of the fastening tool 1 of the embodiment (part 1). The trigger mechanism of the embodiment includes the first switch 30 which is a valve mechanism opened and closed by the trigger lever 21, and the second switch 40 which is a valve mechanism opened and closed by the pressing of the push lever 15 to the driven material. The first switch 30 and the second switch 40 are connected in series in the flow direction of the air, and includes two valve means (described later) that allow or block the inflow of the compressed from the accumulator chamber 50 to the main valve chamber 25 (see FIG. 1). The first switch 30 is a valve mechanism that opens and closes in conjunction with the operation of the trigger lever 21, and allows the compressed air to flow from the accumulator chamber 50 to the second switch side taking the through hole 38 as an inlet when the trigger lever 21 is pulled and rocks in the direction of an arrow 24 as shown in FIG. 2. The second switch 40 is a valve mechanism that opens and closes in conjunction with the movement of the push lever 15, and allows the compressed air to flow from the first switch 30 side to the main valve chamber 25 side when the main body of the fastening tool 1 is pressed to the driven material and the push lever 15 moves to a raised position. The second switch 40 is in a blocking state when the push lever 15 is in the usual position (a bottom dead center position). In the embodiment, a connection pipe 61 is further arranged that is branched from the air passage of the first switch 30 and allows a portion of the compressed air to flow to the relief valve mechanism 60. The connection pipe 61 is configured so that a part of the compressed air is supplied to the connection pipe 61 when the trigger lever 21 is pulled in the direction of the arrow 24, and the air pressure of the connection pipe 61 is released to return to approximately the atmospheric pressure when the trigger lever 21 is released (moving in the direction opposite to the arrow 24).

The relief valve mechanism 60 is arranged in the inner side part of the substantially cylindrical handle part 2*b*, and is configured to include a relief valve piston 65 capable of moving in the axial direction of the handle part 2*b*, a substantially cylindrical relief valve case 70 that accommodates the relief valve piston 65; and a cap 80 that closes one side of an opening surface of the relief valve case 70. The relief valve piston 65 is a discharge valve that uses the air pressure to operate, and functions as a timer valve, which operates after a timer time has elapsed so that the air of the accumulator chamber 50 is discharged to the outside at once if the inflow of air reaches a fixed amount. The air plug 58 that is connected to an unillustrated hose for supplying the compressed air is mounted on the cap 80. One end of the connection pipe 61 is connected to the air flow path of the first switch 30, and the other end is connected to an opening 71*b* of the relief valve case 70. When a discharge operation of the air from the accumulator chamber 50 into the atmosphere is not performed by the relief valve mechanism 60, the air supplied from the air plug 58 flows, as shown by the arrow, through the inner space of the cap 80 and the relief valve piston 65 into the accumulator chamber 50. As a result, the accumulator chamber 50 is maintained to a high air pressure supplied from an outside compressor and so on.

Figure 3:
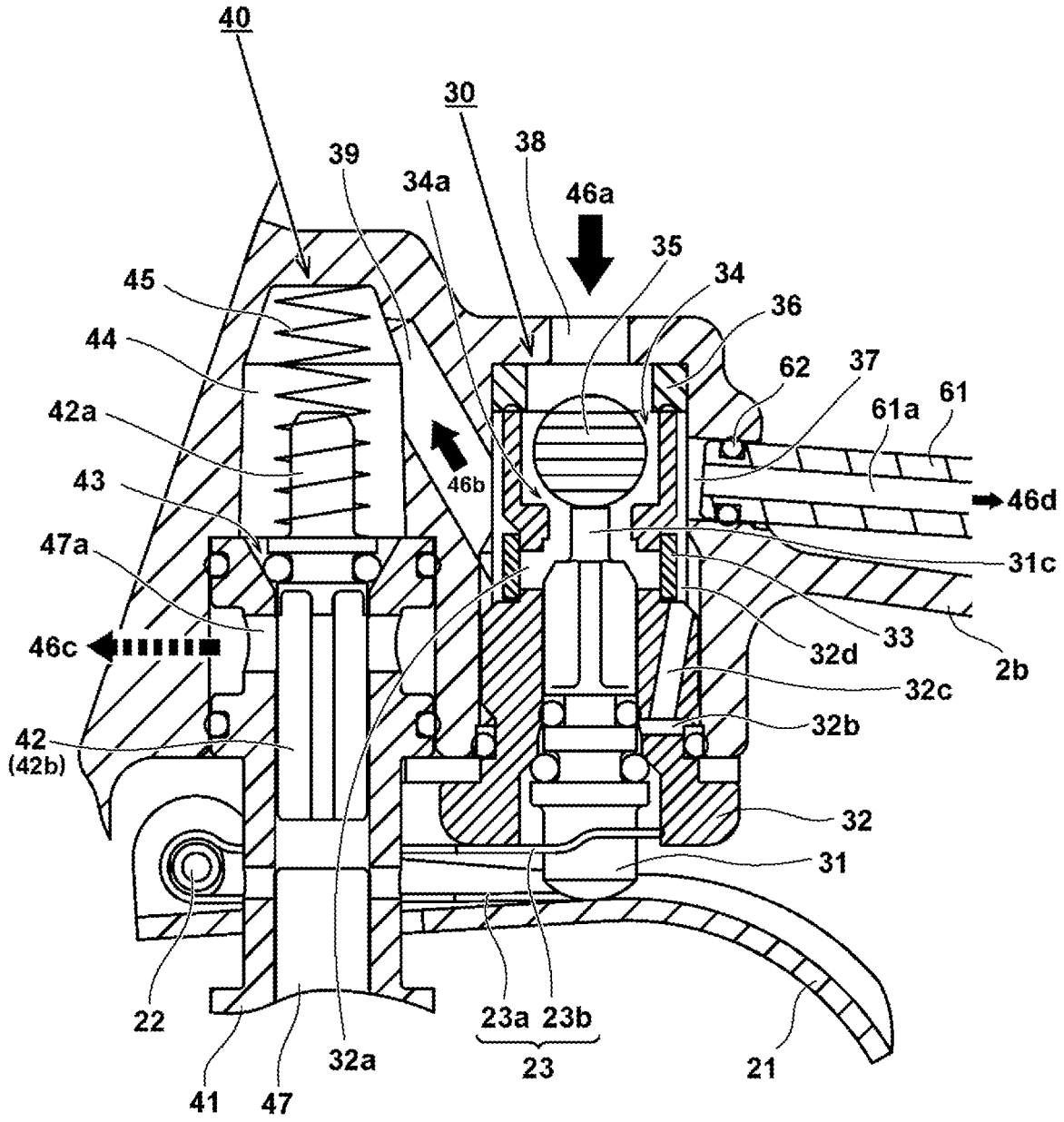
FIG. 3 is an enlarged cross-sectional view near a trigger of FIG. 2.

Next, the operations of the first switch 30 and the second switch 40 are illustrated using FIG. 3. FIG. 3 is an enlarged cross-sectional view near the trigger of FIG. 2, and shows a situation that the first switch 30 is in an ON state (a state of connecting the air passage) and the second switch 40 is in an OFF state (a state of blocking the air passage). In the lower part near the base of the handle part 2*b*, two cylindrical holes extending upward from the bottom are formed. The first switch 30 is accommodated in the inner part on one side of the two cylindrical holes away from the cylinder 10, and the second switch 40 is accommodated in the inner part of one side near the cylinder 10.

By the pulling operation of the operator, the trigger lever 21 is capable of resisting an energizing force applied by a U-shaped thin plate spring 23 that is arranged so as to operate taking the rocking shaft 22 as a center, and moving in a counterclockwise direction, that is, in the upward direction taking the rocking shaft 22 as a center. In the thin plate spring 23, an upper plate 23*b* is in contact with the lower surface of the trigger bush 32, and a lower plate 23*a* is in contact with the upper surface of the trigger lever 21; when the operator releases the trigger lever 21, a trigger plunger 31 is made to move downward by a rotation in a clockwise direction in the drawing.

The compressed air accumulated in the accumulator chamber 50 flows via the through hole 38 to a first valve chamber 34 in the direction of an arrow 46*a*. If the first switch 30 is ON (in the connected state), the air passing through the first switch 30 flows, as shown by an arrow 46*b*, through the air passage 39 into a second valve chamber 44 on the second switch 40 side. If the second switch 40 is ON (in the connected state), a push lever valve 42 which is a valve mechanism of the second switch 40 moves upward, and thus the compressed air passes through an opening part 43 which becomes a valve part, and as shown by an arrow 46*c*, the compressed air is discharged from a through hole 47*a* and flows to the main valve chamber 25 (see FIG. 1). In this way, the compressed air on the accumulator chamber 50 side controls a start of the driving operation of the piston 8 which is a strike driving means by passing through two switch means that are connected in series (the valve mechanism for blocking the air flow).

The first switch 30 is mainly configured by a substantially cylindrical trigger bush 32, a trigger plunger 31 disposed in the trigger bush 32, and a substantially spherical valve member 35. The trigger bushing 32 is screwed to a female screw formed on the cylinder hole side by a male screw formed on the outer peripheral side near the lower side. A packing 36 is interposed in the upper end portion of the trigger bush 32. The valve member 35 is accommodated in the first valve chamber 34 that communicates with the accumulator chamber 50 and the air passage 39, and blocks or opens the air passage by opening or closing a step-shaped opening part 34*a* formed in the inner diameter part of the substantially cylindrical trigger bush 32. The diameter of the opening part 34*a* is smaller than the diameter of the valve member 35. The valve member 35 is constantly energized in the direction of the arrow 46*a* by the action of the compressed air on the accumulator chamber 50 side. Therefore, when the valve member 35 receives a lower pressure via the through hole 38 due to the pressure of the compressed air in the accumulator chamber 50, the valve member 35 is locked in the opening part 34*a* and the first valve chamber 34 is closed. That is, the first switch 30 is in a closed state (OFF).

The trigger plunger 31 is held so as to be capable of moving up and down under the valve member 35. A leading end part 31*c* of the trigger plunger 31 is an action piece for moving the valve member 35, a portion having a shape that the cross-section perpendicular to the axial direction is substantially cross-shaped is formed near the center, and a prescribed space is formed on the outer peripheral side of the trigger plunger 31 to allow the air to flow toward the axial direction. When the lower end part is pressed upward by the trigger lever 21, the trigger plunger 31 presses the valve member 35 of the first switch 30 upward against the pressure of the compressed air, and opens the first switch 30. Therefore, when the opening part 34*a* is opened, the air flows in the axial direction of the trigger plunger 31, reaches an opening part 32*a*, and is discharged to the air passage 39 side through the check valve 33. The check valve 33 can be formed, for example, by a cylindrical rubber member that is continuous in the peripheral direction, and most of the opening part 32*a* communicates with the air passage 39, but a portion of the air also flows to a through hole 37 by a longitudinal groove 32*d*. Therefore, when the opening part 34*a* is opened, the compressed air flowing in as shown by the arrow 46*a* flows via the air passage 39 in the direction of the arrow 46*b*, and is branched to flow to the connection pipe 61 side via the longitudinal groove 32*d* and the through hole 37 as shown by an arrow 46*d*. When the trigger lever 21 is released and the trigger plunger 31 descends, the compressed air remaining inside the air passage 39 and the connection pipe 61 is discharged from the unillustrated discharge port to the outside via a longitudinal hole 32*c* and a radial groove 32*b*. The connecting pipe 61 is an air passage that supplies a portion of the compressed air to the relief valve mechanism 60 side when the trigger lever 21 is pulled, and is formed by a pipe made of metal or synthetic resin. The portion of the connection pipe 61 connected to the through hole 37 is sealed by an O-ring 62 so that the high pressure air of the accumulator chamber 50 is not mixed into the inside of the connection pipe 61.

The second switch 40 is disposed inside a cylinder hole on one side near the cylinder 10, and a small diameter part and a large diameter part are formed in the cylinder hole. The second switch 40 is mainly formed by a substantially cylindrical push lever plunger 41 that is pressed into the large diameter part, a push lever valve 42 that is disposed in the push lever plunger 41, and a coil-like plunger spring 45 that energizes the push lever valve 42 in a prescribed direction. The push lever valve 42 is a valve which switches the blocking or a circulation of the inflow of the compressed air from the air passage 39 to the through hole 47*a* according to the operation of the push lever 15. The push lever plunger 41 is formed into a tubular shape that substantially extends up and down and has a passage inside; the flow of air is blocked (the state of FIG. 3) by contacting a flange-shaped portion of the push lever valve 42 with the opening part 43 formed on the upper end of the push lever plunger 41, and the flow of air is allowed by moving the push lever valve 42 upward and separating the flange-shaped portion from the opening part 43. The through hole 47*a* is formed on the outer periphery side under the opening part 43. The through hole 47*a* becomes an outlet of the flow path from the second valve chamber 44 and is connected to the main valve chamber 25 (see FIG. 1).

The push lever valve 42 moves up and down, and opens or closes the opening part 43 at the upper end of the push lever plunger 41. About half of the push lever valve 42 is accommodated in an upper space of the cylindrical push lever plunger 41, and the push lever valve 42 moves so as to close or open the opening part 43. In the push lever valve 42, a column part 42*a* is formed on the upper side, a flange part is formed near the center in the axial direction, and a recessed part 42*b* having a cross-shaped cross section is formed on the lower side. The air flows from the second valve chamber 44 to the through hole 47*a* via a gap between the recessed part 42*b* and an inner wall surface of the push lever plunger 41. Besides, on the lower side of the flange part, a groove part that is continuous in the peripheral direction is formed to dispose a sealing member such as an O-ring. The column part 42*a* is disposed on the inner side of the coil-like plunger spring 45. In this way, in a state that the lower side surface of the flange part is in contact with the upper surface of the step-shaped opening part 43 (the state of FIG. 3), the flow path of the second switch 40 can be closed. The push lever valve 42 is energized downward by the plunger spring 45, and resists the energizing force of the plunger spring 45 by the press of the push lever plunger 41 to move upward.

One end of the plunger spring 45 is held on a housing 2 side, and the other end is in contact with the upper surface of the flange portion of the push lever valve 42. The push lever bush 47 moves up and down along with the push lever 15 to move the push lever valve 42. If the trigger lever 21 is pulled in a state of cooperating with the push lever 15, the compressed air accumulated in the accumulator chamber 50 is supplied to the main valve chamber 25 (see FIG. 1) via the first switch 30 and the second switch 40, so that a large amount of compressed air flows into the cylinder 10 and the piston 8 is driven from the top dead center to the bottom dead center. Accordingly, the driver blade 9 fixed to the piston 8 strikes the front nail (not illustrated) that is fed from the magazine 6 to the injection passage 4*b*, and drives the nail from the leading end of the nose member 4 into the driven member. Any one of the first switch 30 and the second switch 40 is in an OFF state by opening the trigger lever 21 or releasing the press of the push lever 15 after driving the nail, and thus a supply of the compressed air from the accumulator chamber 50 side to the cylinder 10 is blocked.

In the embodiment, a premise configuration of the fastening tool provided with the relief valve mechanism 60 is the existence of the first switch 30 that operates by the push lever 15 and the trigger lever 21, but whether to arrange the second switch 40 in addition to the first switch 30 is optional; even if the second switch 40 is not arranged, as long as it is configured so that the first switch 30 does not operate when the push lever 15 is not pressed, and a "continuous driving mode" is included in which the main body of the fastening tool 1 moves up and down to continuously drive the fasteners in a state of maintaining the pull operation of the trigger lever 21, other switch mechanism may also be used.

In a "single driving mode", if one driving is completed, once the trigger lever 21 is released and the trigger is off, the next driving is not performed as long as the trigger lever 21 is not pulled again (evidently, it is a necessary condition that the push lever 15 is in a state of being pressed to the driven material when performing the next driving operation). On the other hand, in the "continuous driving mode", the operator keeps pulling the trigger lever 21 without returning the trigger lever 21 after completing the first driving; in this state, when the main body of the fastening tool 1 is moved and the push lever 15 is pressed to the next driving position of the driven material, the nail can be driven at this time. That is, when the operator keeps pulling the trigger lever 21 without returning the trigger lever 21 after completing the driving, the first switch 30 is maintained in the ON state, and the flow of the compressed air can be released and blocked on the second switch 40 side. The setting of the "continuous driving mode" in this way is very convenient and easy to use in such operations as to drive a lot of nails continuously. The reason is that the push lever 15 may only be positioned and pressed to the next driving position when the trigger lever 21 is maintained in the pulling state. However, considering a case that the operator forms a habit of such a continuous driving, a case that the operation that carefully specifies the driving position is performed after the continuous driving, and a case that the driving position is slightly adjusted without returning the trigger lever 21, sometimes there is an occasion that a driving (miss shot) to the position slightly deviated from the desired driving position is performed.

In the embodiment, in order to greatly eliminate this concern, when the operator keeps pulling the trigger lever 21 in the "continuous driving mode", the air in the accumulator 50 is compulsorily discharged after a prescribed time has elapsed, thereby making it impossible to perform subsequent continuous driving. However, there is a concern that if the operator arbitrarily discharges the air of the accumulator chamber 50 without noticing, a driving cannot be performed at once when the continuous driving is performed and the next driving happens to be delayed, leading to a hindrance to the operation. Therefore, in the embodiment, the convenience of the operator is further improved by the following way, that is, instead of discharging the compressed air of the accumulator chamber 50 at once without a notice after a prescribed time has elapsed, a predictive notification sound is made for the prescribed time before the discharge, and the high pressure air of the accumulator chamber 50 is compulsorily discharged after the notification sound is made for the prescribed time. The predictive notification sound (alarming sound) may not only use an air leakage sound, but also use a speaker or an electrical control means. In the embodiment, as an implementation form suitable for an air tool that is not provided with an electrical control means such as a battery, an example of making a sound by using the compressed air is illustrated. If the operator hearing the notification sound returns the trigger lever 21, the careless pulling state of the trigger lever 21 can be prevented from being maintained and the miss shots can be reduced. In addition, in the case of restarting the next nail driving after the continuous driving operation is interrupted, the subsequent nail driving operation can be continued without hindrance by temporarily releasing the trigger lever.

Figure 4:
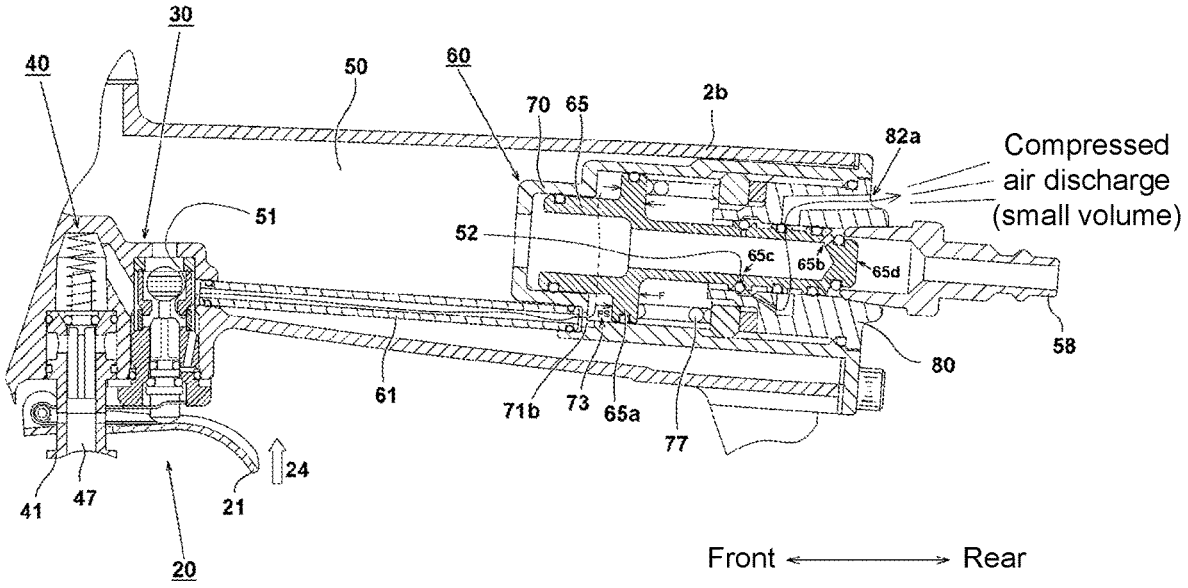
FIG. 4 is an enlarged cross-sectional view showing the structure near the handle part 2*b* of the fastening tool 1 according to the embodiment of the present invention (when a notification sound is made).

FIG. 4 is an enlarged cross-sectional view showing the structure near the handle part 2*b* of the fastening tool 1 according to the embodiment of the present invention, and shows a state of making a predictive notification sound. Here, a state is shown that the trigger lever 21 is pulled for a few seconds from a state that the pressure inside the accumulator chamber 50 returns to the prescribed high pressure state after the nail driving is performed in the "continuous driving mode". The trigger lever 21 is maintained at the pulling state since the completion of the last driving, and thus the compressed air of the accumulator chamber 50 flows, as shown by an arrow 51, from the opening 71*b* into the inner space of the relief valve case 70 through the inside of the connection pipe 61. The inflow air flows into a space (the air chamber 73) on the front surface side of the flange part 65*a* of the relief valve piston 65. As a result, a prescribed force PS is applied by the pressure of the air that flows in, and a force enabling the relief valve piston 65 to move to the rear side is applied. On the other hand, on the rear side of the flange part 65*a*, the relief valve piston 65 is energized to the front side by the spring 77. Therefore, a force F is applied from the rear side of the flange part 65*a*, and the relief valve piston 65 is stopped in the position where the pressure PS and the force F are equal. The rear end part 65*d* of the cylindrical relief valve piston 65 is closed, and a through hole 65*b* and a through hole 65*c* that communicate with the outer space from the inner space are formed. As shown in FIG. 2, the through hole 65*b* is an inflow passage from the air plug 58 side to the accumulator chamber 50. The through hole 65*c* is a passage for discharging a portion of the air of the accumulator chamber 50 to the outside.

Figure 5:
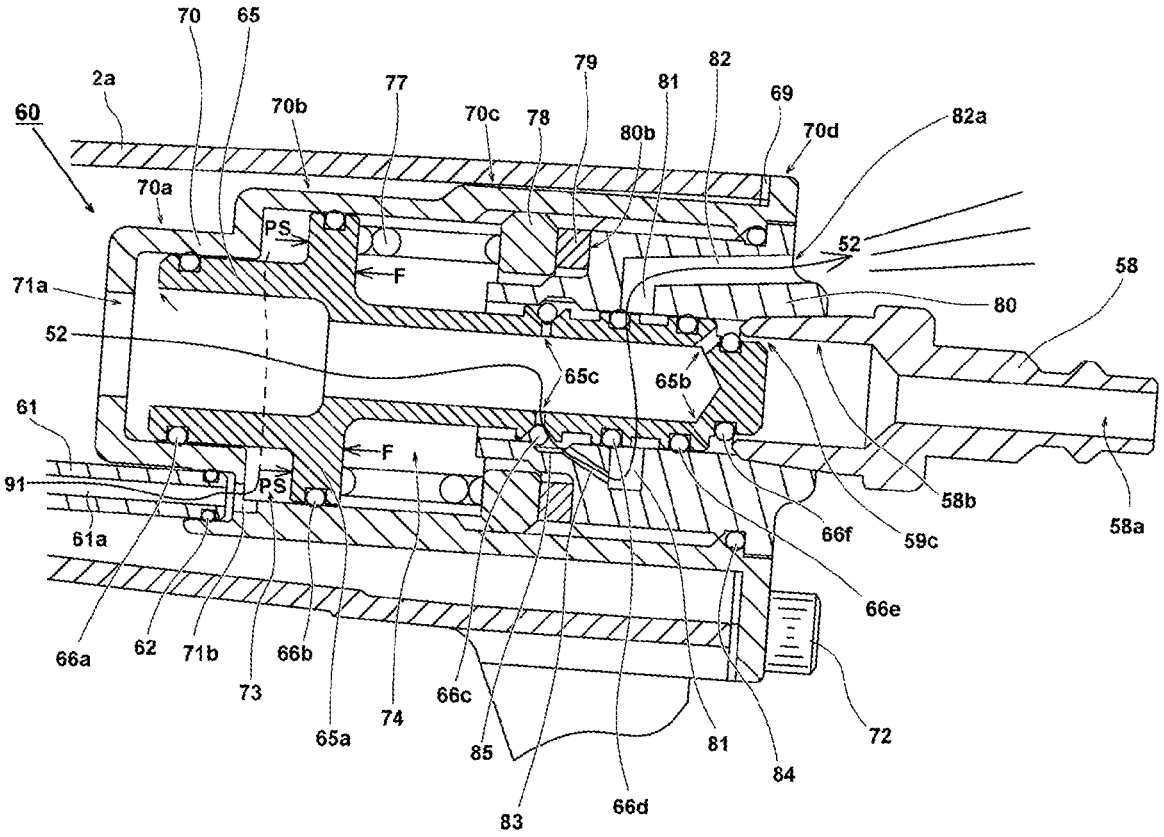
FIG. 5 is an enlarged cross-sectional view near a relief valve mechanism 60 of FIG. 4.

Next, a detailed structure of the relief valve mechanism 60 is illustrated using FIG. 5. FIG. 5 is an enlarged view near the relief valve mechanism 60 of FIG. 4. The relief valve case 70 is formed into a cup shape and is installed from an opening on the rear side toward an inner part on the front side of the cylindrical handle part 2*b*. In the relief valve case 70, a large through hole 71*a* that allows the air to pass through is formed on the bottom part located on the front side, and the side wall portion is expanded in a step-wise manner like a small diameter part 70*a* with an outer periphery of small diameter, a medium diameter part 70*b*, and a large diameter part 70*c*, and the circumference of the opening surface is formed into a flange part 70*d* that extends toward the outside in the radial direction. A packing 69 is interposed between the flange part 70*d* and the terminal portion of the hand part 2*b* and is fixed by a screw 72. The inner space of the cylindrical relief valve case 70 becomes a sliding space for the relief valve piston 65 to move forward and rearward. A plurality of O-rings 66*a*-66*e* are arranged between the outer wall of the relief valve piston 65 and the inner wall of the relief valve case 70 or the cap 80. Besides, an O-ring 66*f* is also arranged in the vicinity adjacent to the air plug 58, which is near the rear end of the outer wall of the relief valve piston 65. An O-ring 84 is also arranged between the outer periphery side of the cap 80 and the relief valve case 70. In this case, according to a relative positional relationship between the through holes 65*b*, 65*c* formed in the substantially cylindrical relief valve piston 65 in which one end side is closed and a passage formed on the inner periphery side of the cap 80, an inflow of the air from the air plug 58 side to the inner space of the relief valve piston 65 and a release of air from the inner space of the relief valve piston 65 via the cap 80 to the atmosphere are controlled. That is, the relief valve piston 65 functions as an opening and closing valve of an inlet passage and an outlet passage of the air.

The cap 80 becomes a fixture member for holding the rear side of the relief valve piston 65 and holding the air plug 58. The relief valve case 70, the relief valve piston 65, and the cap 80 can be made of an integral product of metal or synthetic resin. In the inner peripheral surface of the cap 80, an annular groove 81 that is continuous in a circumferential direction is formed, and an atmosphere passage 82 is formed penetrating from a portion of the annular groove 81 (the upper side in the present invention) toward the rear side. The end part of the atmosphere passage 82 far from the annular groove 81 becomes the discharge port 82*a* communicating with the atmosphere. An inclined narrow passage 83 is formed from the other part (the lower side in the present invention) of the annular groove 81 to the front side. An annular groove 85 that is continuous in the circumferential direction is formed on the front side of the passage 83. The cross-sectional shape of the annular groove 85 (the cross section as shown in FIG. 5) is trapezoid, and the through hole 65*c* is adjacent to the inside of the annular groove 85. The through hole 65*c* is formed in a plurality of positions in the circumferential direction, and the cross-sectional shape is partially thinner on the outer periphery side of the through hole 65*c*, and an O-ring 66*c* is disposed in the thinner portion.

When the relief valve piston 65 is located on the front side as shown in FIG. 2, the space between the relief valve piston 65 and the inner wall of the cap 80 is narrow, and thus the O-ring 66*c* cannot move to the outside in the radial direction, therefore the through hole 65*c* is in a closed state. On the other hand, if the relief valve piston 65 moves to the rear side as shown in FIG. 4 and FIG. 5, the O-ring 66*c* is in contact with an inclined surface of the annular groove 85; accordingly, the through hole 65*c* is slightly opened, and the compressed air from the accumulator chamber 50 is discharged to the outside in the direction of an arrow 52, that is, via the through hole 65*c*, the passage 83, the annular groove 81, and the atmosphere passage 82. In this case, because the through hole 65*c* is only slightly opened, a slight amount of air is discharged to the atmosphere. Besides, the compressed air is also supplied from the O-ring 66*c* which forms a check valve to a spring chamber 74 side, and the pressure F is generated to cause the flange part 65*a* to move toward the left. Therefore, even if the pressure PS from the air chamber 73 rises, the pressure F from the spring chamber 74 side also rises in a similar way, so that the movement of the relief valve piston 65 toward the right becomes slow. In addition, a spring pressure adjusting ring 78 is arranged to adjust an energizing force of the spring 77. The spring pressure adjusting ring 78 is splined with the cap 80, and the back end side is held by an elastomer damper 79 such as a rubber ring. The elastomer damper 79 is disposed in contact with a step portion 80*b* of the cap 80. The cap 80 is configured in a manner that the cap 80 is held not to be pulled out from the relief valve case 70 to the rearward of the axial direction, but can rotate in a rotation direction. Besides, the outer peripheral surface of the spring pressure adjusting ring 78 becomes a male screw, and the inner peripheral portion (a portion on the inner peripheral side of the large diameter part 70*c*) of the relief valve case 70 facing the spring pressure adjusting ring 78 becomes a female screw, and thus the spring pressure adjusting ring 78 is also rotated by rotating the cap 80; accordingly, the axial direction of the spring pressure adjusting ring 78 can be adjusted. As a result, the spring pressure adjusting ring 78 can adjust the strength of the energizing force applied by the spring 77 to the relief valve piston 65, and functions as an adjusting mechanism to adjust a time from keep pulling the trigger lever 21 to starting making the notification sound, or a time required for discharging the compressed air.

An opening area of the discharge port 82*a* is properly set, and is configured in a manner that the air leakage sound such as "whew" is sufficient to be heard by the operator among the noise in normal operation when discharging the air. This sound may not be too loud and not be a harsh sound. Besides, a member such as a whistle may be added to the discharge port 82*a*, or a through hole may be further formed which intersects with the discharge direction of the atmosphere passage 82 and a loud sound is made due to a principle of the whistle. The sound may be made for a certain length of time, for example, for 3-5 seconds instead of only for a moment. Accordingly, when the notification sound is made, the operator can easily determine whether to perform the next driving operation or to return the trigger lever 21. In addition, even in a state of making the sound, that is, even when a portion of the compressed air leaks to the outside as shown by the arrow 52, the rear peripheral portion of the relief valve piston 65 is separated from the leading end of a thick inner wall part 58*b* of the air plug 58 as shown by an arrow 59*c*; therefore, the air flowing from a thin inner wall part 58*a* of the air plug 58 is replenished to the accumulator chamber 50 through the through hole 65*b*. Therefore, the internal pressure of the accumulator chamber 50 is kept at a fixed level, so that the next nail driving operation can be performed even when the notification sound is made.

As described above, after a prescribed time has elapsed since the completion of the nail driving, for example, after about 3-5 seconds has elapsed, by releasing a portion of the compressed air to the atmosphere, an alarming by a sound can be made to notify the operator that the trigger lever 21 has not been returned.

Figure 6:
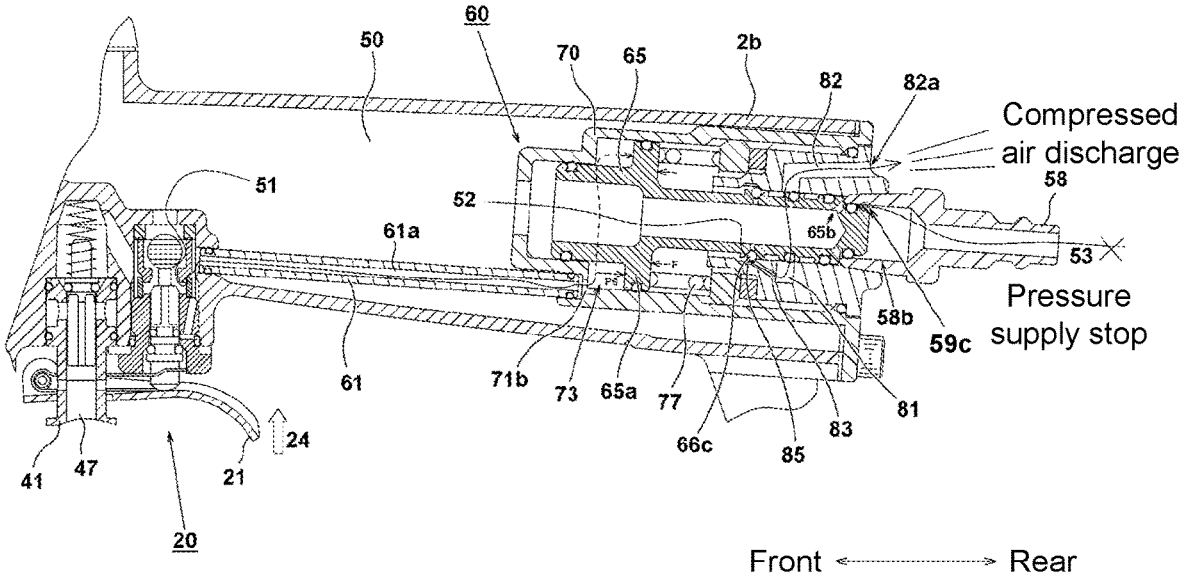
FIG. 6 is an enlarged cross-sectional view showing the structure near the handle part 2*b* of the fastening tool 1 according to the embodiment of the present invention (during compulsory discharge).

Next, a state after the notification sound continues for several seconds in the state of FIG. 5 is illustrated using FIG. 6. Here, it is a state that the operator does not press the push lever 15 to the driven material (a state that the second switch 40 is off), but it is a state that the trigger lever 21 is being pulled (a state that the first switch 30 is on), therefore the compressed air of the accumulator chamber 50 continues to flow as shown by an arrow 51, and the pressure PS to the flange part 65*a* of the relief valve piston 65 in the inner space of the relief valve case 70 continues to increase. As a result, the relief valve piston 65 further moves to the right side compared with the state in FIG. 4 and FIG. 5, and the O-ring 66*c* moves to a position facing the bottom surface of the annular groove 85. Therefore, the through hole 65*c* is greatly opened, and the compressed air from the accumulator chamber 50 is discharged to the outside at once via the passage 83, the annular groove 81, the atmosphere passage 82, and the discharge port 82*a* in the pathway of the arrow 52. During the discharge, the sound becomes a loud sound which is different from the above-described notification sound. In this case, the rear outer peripheral portion of the relief valve piston 65 is closely connected to the leading end of the thick inner wall part 58*b* of the air plug 58, and thus the through hole 65*b* is closed and the inflow of the air from the air plug 58 side to the accumulator chamber 50 as shown by an arrow 53 is prevented. Therefore, the internal pressure of the accumulator chamber 50 is reduced to the atmospheric pressure at once. When the pressure of the accumulator chamber 50 returns to the atmospheric pressure, the driving operation is not performed even if the operator presses the push lever 15 to the driving material.

If the operator releases the trigger lever 21 from the state of FIG. 6, a cross-shaped portion of the trigger plunger 31 of the first switch 30 in FIG. 3 faces the radial groove 32*b*, and the radial groove 32*b* communicates with the atmosphere accordingly. As a result, the remaining air in the inner space 61*a* of the connection pipe 61 and the air chamber 73 is discharged to the atmosphere, and thus the pressure PS applied to the relief valve piston 65 is reduced. As a result, the force F of the spring>the pressure PS of the air chamber 73, and the relief valve piston 65 moves in a manner of returning to the position shown in FIG. 2. The pressure of the compressed air applied in the direction of the arrow 53 also contributes to the movement.

Next, a relationship between the states of each part until discharging the air of the accumulator chamber of the embodiment is illustrated using FIG. 7. In (1)~(5) of FIG. 7, each horizontal axis refers to the time (unit: second), and these horizontal axes are combined to be illustrated. The driving mode of the fastening tool 1 is the continuous driving mode. (1) of FIG. 7 shows an operation of the trigger lever 21 (a trigger operation 91). Here, the trigger lever 21 is pulled by the operator since the time $t_1$ when the previous driving operation is started, and the pulling state is continued until the time $t_5$. (2) of FIG. 7 is a drawing showing a state of the push lever 15. At the time $t_1$, the operator pulls the trigger lever 21 and presses the leading end (the lower end) of the push lever 15 to the object (the driven material) to which the nail is driven at the same time. Then, a push lever operation 92 is on at the time $t_1$ and the driving operation of the nail is performed. If the nail is driven, due to a reaction, the main body of the fastening tool 1 moves in the direction away from the driven material, and thus the push lever 15 is off at the time $t_2$. At the time $t_2$, the nail driving is completed.

(3) of FIG. 7 is a drawing showing an accumulator chamber pressure 93, and the longitudinal axis refers to the pressure (unit: Pa). Here, the compressed air sending from the external compressor (not illustrated) via the air plug 58 is used to strike, so that the pressure 93 of the accumulator chamber 50 is reduced as shown by an arrow 93*a* from the time $t_1$ to time $t_2$. However, after this, the compressed air is replenished immediately via the air plug 58, and thus the pressure of the accumulator chamber 50 returns to the prescribed pressure P in the position of an arrow 93*b*. (4) of FIG. 7 shows a flow rate of the air flowing from the external compressor via the air plug 58. Here, at the time 0 to $t_1$, the accumulator chamber 50 is at the prescribed high pressure P and thus there is no inflow of the air. At the time $t_1$-$t_2$ in which the nail driving is performed and shortly after the time $t_2$, the air flows in as shown by an arrow 94*a*. However, when a state of pulling the trigger lever 21 is maintained for a prescribed time, about 3 seconds here, since the time $t_2$ at which the driving is completed instead of performing the next driving, a portion of the compressed air is discharged from the discharge port 82*a* to the outside just before the time $t_3$ as shown in FIG. 4, and a discharge sound accompanying the discharge is made. The sound is continued for about 4 seconds from the time $t_3$ to time $t_4$. During the period from the time $t_3$ to time $t_4$, the compressed air is replenished from the external compressor as shown by an arrow 94*b*, therefore, as seen from (3) of FIG. 7, the pressure of the accumulator chamber 50 is maintained at the prescribed pressure P. Accordingly, a driving can be normally performed when the notification sound is made.

After that, at the time $t_4$, the flow path from the air plug 58 to the accumulator chamber 50 is closed as shown in FIG. 6, and thus a compressor flow rate 94 in (4) of FIG. 7 is zero as shown by an arrow 94*c*. At the same time, the O-ring 66*c* in FIG. 5 is greatly opened, and thus the air of the accumulator chamber 50 is discharged, and the accumulator chamber pressure 93 is rapidly reduced as from an arrow 93*c* to an arrow 93*d* of (3) of FIG. 7. Then, if the operator releases the trigger lever 21 at the time $t_5$, the relief valve piston 65 moves again to the trigger lever 21 side as shown in FIG. 2, and thus the compressed air flows from the air plug 58 to the accumulator chamber 50 as shown by an arrow 94*d*. As a result, the pressure of the accumulator chamber also increases as shown by an arrow 93*e* in (3) of FIG. 7, and the next strike can be performed at the time $t_6$.

(5) of FIG. 7 is a graph that shows a force applied to the flange part 65*a* of the relief valve piston 65, that is, a value 95 of P×S. $P_1$ refers to the pressure of the air chamber 73, and S refers to cross-sectional area of the front surface side of the flange part 65*a*. Here, at the time t3, the position of the relief valve piston 65 moves back as shown in FIG. 5, and thus the air starts to leak out and the P×S increases as shown by an arrow 95*a*. Then, at the time $t_4$, a pressure $P_1$×S for preventing the inflow from the air plug 58 is reached. This state is maintained until the operator returns the trigger lever 21; if the trigger lever 21 is returned at the time $t_5$, the air of the air chamber 73 is discharged via the vicinity of the first switch 30, and thus the value 95 of P×S decreases from the time $t_5$ to the time $t_6$ as shown by an arrow 95*b* and returns to zero. At the time $t_6$, only a force of the spring 77 is applied to the relief valve piston 65, and thus the relief valve piston 65 returns to an original position shown in FIG. 2.

According to the embodiment, if a state of pulling the trigger lever 21 continues for a first time or longer when the push lever 15 is in the second position, the notification sound is made; if the notification sound continues for a second time, the air in the accumulator chamber is discharged to the outside at once and the pressure of the accumulator chamber is reduced. Therefore, the operator can realize not to pull trigger lever 21 unnecessarily. The notification function of the notification sound is to make a sound by discharging a portion of the air of the accumulator chamber, and thus an electrical component is not required. Furthermore, the function can be relatively easily realized by arranging a connection pipe 61 and a relief valve mechanism 60 inside the handle part of the conventional fastening tool.

The present invention is described above based on the embodiments, but the present invention is not limited to the above embodiments and various modifications can be made within a scope not departing from the spirit of the present invention. For example, in the above embodiments, the relief valve mechanism 60 is realized by the trigger mechanism using two trigger valve mechanisms, namely the first switch 30 and the second switch 40. However, the configuration of the trigger valve mechanism side is not limited thereto; as long as it is a trigger mechanism that operates in conjunction with the ON state of the trigger switch and can introduce the compressed air to the connection pipe 61, the present invention can also be applied similarly in a so-called single-valve trigger mechanism. Besides, in the above embodiments, the relief valve mechanism 60 is disposed in a place that is the inner part of the hand part 2*b* and where the air plug 58 is mounted, but the position for arranging the relief valve mechanism 60 is optionally. As long as a relief mechanism can be realized which is capable of controlling the inflow of air from the air plug and the discharge of air of the accumulator chamber in conjunction, configurations other than the above-described embodiments may be adopted.

Moreover, in the above embodiments, a "sound" using the release of the compressed air is illustrated as the alarming means, but the alarming means can also be other alarming means, for example, a structure in which a rotating member (an impeller and so on) with an eccentric weight is arranged in the discharge pathway of the compressed air, and oscillation (vibration) is generated in the main body (especially the handle part) along with the discharge of the compressed air; besides, the alarming may be performed in the following way, that is, a rotating member (an impeller and so on) with a small magneto coil is arranged on the discharge pathway of the compressed air, and an electromotive force generated by rotation is used to make a sound from a piezoelectric buzzer or a speaker, or to turn on a LED and the like arranged in a position easily seen by the user.

DESCRIPTION OF THE SYMBOLS

1 fastening tool
2 housing
2*a* body part
2*b* handle part
3 top cover
4 nose member
4*a* leading end
4*b* injection passage
6 magazine
8 piston
9 driver blade
10 cylinder
11 return air chamber
12*a* air hole
12*b* air hole
13 check valve
14 spring
15 push lever
16*a* arm part
16*b* coupling part
17 connection part
18 head cap
19 valve holding member
20 trigger
21 trigger lever
22 rocking shaft
23 thin plate spring
23*a* lower plate
23*b* upper plate
25 main valve chamber
26 piston bumper
30 first switch
31 trigger plunger
31*c* leading end part
32 trigger bush
32*a* opening part
32*b* radial groove
32*c* longitudinal hole
32*d* longitudinal groove
33 check valve
34 first valve chamber
34*a* opening part
35 valve member
36 packing
37 through hole
38 through hole
39 air passage
40 second switch
41 push lever plunger
42 push lever valve
42*a* cylindrical part
42*b* recessed part
43 opening part
44 second valve chamber
45 plunger spring
47 push lever bush
47*a* through hole
48 push lever bush cover
50 accumulator chamber
58 air plug
58*a* thin inner wall part
58*b* thick inner wall part
60 relief valve mechanism
61 connection pipe
61*a* inner space (of connection pipe)
62 O-ring
65 relief valve piston
65*a* flange part
65*b* through hole
65*c* through hole
65*d* rear end part
66*a*-66*f* O-ring
69 packing
70 relief valve case
70*a* small diameter part
70*b* medium diameter part
70*c* large diameter part
70*d* flange part
71*a* through hole
71*b* opening
72 screw
73 air chamber
74 spring chamber
77 spring
78 spring pressure adjusting ring
79 elastic body bumper
80 cap
80*b* step portion
81 annular groove
82 atmosphere passage (discharge passage)
82*a* discharge port
83 passage
84 O-ring
85 annular groove
91 trigger operation
92 push lever operation
93 accumulator chamber pressure
94 compressor flow rate
101 fastening tool
102 housing
102*a* body part
102*b* handle part
106 magazine
130 first switch
150 accumulator chamber
172 screw
180 cap

What is claimed is:

1. A fastening tool comprising:

a housing comprising a substantially cylindrical body part and a handle part extending from the body part in a substantially perpendicular direction;

an air plug arranged on an end part of the handle part which is separated from the body part, wherein the air plug is configured to be supplied a compressed air;

an accumulator chamber that is configured to be a part of the housing and accumulates the compressed air;

a piston that reciprocates in a cylinder due to the compressed air;

a driver blade that is connected to the piston and drives a fastener;

a nose member having an injection port for injecting the fastener;

a push lever that moves to a first position along the nose member when causing a leading end of the injection port to move in a pressing direction toward a driven material, and is located at a second position when the leading end of the injection port is not pressed to the driven material;

a trigger that actuates a switch mechanism which controls air discharge of the accumulator chamber, wherein in a state that the push lever is moved to the first position and the trigger is pulled, by communicating the accumulator chamber with an upper chamber of the piston, the compressed air in the accumulator chamber flows into the cylinder and a strike is performed accordingly; and the fastening tool comprising a relief valve mechanism that has a control valve of a discharge pathway and an opening and closing valve of an inflow pathway from the air plug to the accumulator chamber, wherein the control valve is configured to discharge at least a portion of the compressed air to an outside, and the opening and closing valve is configured to close the inflow pathway, and the control valve and the opening and closing valve are controlled by the compressed air by pulling the trigger when the push lever is in the second position.

2. The fastening tool according to claim 1, wherein after the air in the accumulator chamber is discharged to the outside at once, a state that the inflow pathway is closed is maintained until the state that the trigger is pulled is released.

3. The fastening tool according to claim 2, wherein the relief valve mechanism comprises: a relief valve piston that can be used as both the opening and closing valve of the inflow pathway and the control valve of the discharge pathway; and a relief valve case defining a space that allows the relief valve piston to slide and forming an inflow passage and a discharge passage; and a connection pathway is arranged in which a portion of the compressed air is supplied from the trigger to the air chamber between the relief valve piston and the relief valve case in order to perform the movement of the relief valve piston.

4. A fastening tool comprising:

a housing comprising a substantially cylindrical body part and a handle part extending from the body part in a substantially perpendicular direction;

an air plug arranged on an end part of the handle part which is separated from the body part, wherein the air plug is configured to be supplied a compressed air;

an accumulator chamber that is configured to be a part of the housing and accumulates the compressed air;

a piston that reciprocates in a cylinder due to the compressed air;

a driver blade that is connected to the piston and drives a fastener;

a nose member having an injection port for injecting the fastener;

a push lever that moves to a first position along the nose member when causing a leading end of the injection port to move in a pressing direction toward a driven material, and is located at a second position when the leading end of the injection port is not pressed to the driven material; and a trigger that actuates a switch mechanism which controls air discharge of the accumulator chamber, wherein in a state that the push lever moves to the first position and the trigger is pulled, by communicating the accumulator chamber with an upper chamber of the piston, the compressed air in the accumulator chamber flows into the cylinder and a strike is performed accordingly;

wherein in the fastening tool, the air plug that supplies the compressed air to the accumulator chamber is arranged in the housing, a discharge port for discharging the compressed air in the accumulator chamber is arranged, a relief valve that operates by an air pressure of the compressed air and opens and closes the discharge port is arranged near the air plug, and an air passage is arranged that supplies a portion of the compressed air to the relief valve side when the trigger is pulled; and a prescribed amount of air flows to the relief valve through the air passage and a pressure of a valve chamber increases gradually, and the compressed air in the accumulator chamber is discharged to the outside of the housing if the air pressure acting on the relief valve increases.

5. The fastening tool according to claim 4, wherein the relief valve has a relief valve piston and comprises: an air chamber for receiving the pressure of the air supplied from the air passage; an energizing means for energizing the relief valve piston in a direction opposite to the pressure; and an inflow passage of the compressed air from the air plug to the accumulator chamber; and wherein the relief valve opens the discharge port and closes the inflow passage when discharging the compressed air in the accumulator chamber to the outside of the housing.

6. The fastening tool according to claim 5, wherein a spring pressure adjusting ring that adjusts a required time from a start of an operation of the trigger to a discharge of the compressed air by adjusting a strength of a force applied to the relief valve piston is arranged.

7. The fastening tool according to claim 6, wherein if the trigger is returned after the compressed air is discharged, the discharge port is closed and the inflow passage is opened by releasing the air in the valve chamber to an atmosphere.

8. A fastening tool comprising:

a housing comprising a substantially cylindrical body part and a handle part extending from the body part in a substantially perpendicular direction;

an air plug arranged on an end part of the handle part which is separated from the body part, wherein the air plug is configured to be supplied a compressed air;

an accumulator chamber that is configured to be a part of the housing and accumulates the compressed air, wherein the air plug supplies the compressed air to the accumulator chamber from a connection hose in outside;

a piston that reciprocates in a cylinder due to the compressed air;

a driver blade that is connected to the piston and drives a fastener;

a nose member having an injection port for injecting the fastener;

a push lever that moves to a first position along the nose member when causing a leading end of the injection port to move in a pressing direction toward a driven material, and is located at a second position when the leading end of the injection port is not pressed to the driven material;

a trigger that actuates a switch mechanism which controls air discharge of the accumulator chamber, wherein in a state that the push lever moves to the first position and the trigger is pulled, by communicating the accumulator chamber with an upper chamber of the piston, the compressed air in the accumulator chamber flows into the cylinder, and a strike is performed accordingly;

wherein in the fastening tool, an air driven timer valve is arranged to block an air passage from the air plug to the accumulator chamber, and opens and closes a discharge port for discharging the compressed air from the accumulator chamber to an atmosphere, and if a state of the trigger being pulled continues for a prescribed time or longer when the push lever is in the second position, the compressed air in the accumulator chamber is released to the outside by the air driven timer valve, and the air passage from the air plug to the accumulator chamber is blocked.

9. The fastening tool according to claim 8, wherein before reaching the prescribed time, a portion of the air which flows into the air driven timer valve leaks to the outside of the housing, thereby notifying an operator of a discharge operation of the accumulator chamber by an air leakage sound.

10. The fastening tool according to claim 9, wherein after the air leakage sound continues for a prescribed time or longer, the compressed air in the accumulator chamber is released to the outside and the air passage from the air plug to the accumulator chamber is blocked.

* * * * *